US009596950B2

(12) United States Patent
Waalkes et al.

(10) Patent No.: US 9,596,950 B2
(45) Date of Patent: Mar. 21, 2017

(54) DISPLAY LIGHTING SYSTEM

(71) Applicant: Amstore Corporation, Grand Rapids, MI (US)

(72) Inventors: James W. Waalkes, Walker, MI (US); Ryan A. Van Sluyters, Ada, MI (US)

(73) Assignee: Amstore Corporation, Grand Rapids, MI (US)

( * ) Notice: Subject to any disclaimer, the term of this patent is extended or adjusted under 35 U.S.C. 154(b) by 71 days.

(21) Appl. No.: 14/844,680

(22) Filed: Sep. 3, 2015

(65) Prior Publication Data

US 2016/0061429 A1 Mar. 3, 2016

Related U.S. Application Data

(60) Provisional application No. 62/045,162, filed on Sep. 3, 2014.

(51) Int. Cl.

| | |
|---|---|
| ***F21V 23/06*** | (2006.01) |
| ***F21S 4/00*** | (2016.01) |
| ***F21V 21/34*** | (2006.01) |
| ***H01R 25/14*** | (2006.01) |
| ***A47F 11/10*** | (2006.01) |
| *F21W 131/405* | (2006.01) |
| *H01R 24/38* | (2011.01) |

(52) U.S. Cl.

CPC ..... *A47F 11/10* (2013.01); *H01R 25/142* (2013.01); *F21V 23/06* (2013.01); *F21W 2131/405* (2013.01); *F21Y 2103/10* (2016.08); *F21Y 2115/10* (2016.08); *H01R 24/38* (2013.01); *H01R 25/145* (2013.01); *H01R 25/147* (2013.01)

(58) Field of Classification Search

CPC ..... A47F 11/10; H01R 25/142; H01R 25/145; H01R 25/147; F21V 23/06; F21Y 2103/10; F21Y 2115/10; F21W 2131/405

See application file for complete search history.

(56) References Cited

U.S. PATENT DOCUMENTS

| | | | |
|---|---|---|---|
| 4,689,726 | A | 8/1987 | Kretzschmar |
| 5,034,861 | A | 7/1991 | Sklenak et al. |

(Continued)

FOREIGN PATENT DOCUMENTS

| | | |
|---|---|---|
| WO | 2008035248 | 3/2008 |
| WO | 2008065383 | 6/2008 |
| WO | 2015005187 | 2/2015 |

*Primary Examiner* — Alan Cariaso

(74) *Attorney, Agent, or Firm* — Warner Norcross and Judd, LLP

(57) ABSTRACT

A lighting system including a low voltage frame, a puck magnetically joinable with the frame, a lighting array, and an elongated electrical connector joining the puck and the lighting array. The puck can be selectively positioned along the low voltage frame in a variety of different locations. The puck can be constructed from a polymeric material molded over electrical connectors, and optionally a power feed, such as a cable jack. The electrical connectors can be magnetized so that the electrical connectors are magnetically attracted to power rails on the low voltage frame to establish electrical coupling of the connectors to the power rails, while physically securing the puck in a fixed location along the low voltage frame. The power rails can be constructed from magnetic stainless steel, optionally coated with black oxide from a hot black oxide coating process.

20 Claims, 5 Drawing Sheets

(56) References Cited

U.S. PATENT DOCUMENTS

| | | | | |
|---|---|---|---|---|
| 5,072,343 | A | 12/1991 | Buers | |
| 5,154,509 | A | 10/1992 | Wulfman et al. | |
| 5,205,638 | A | 4/1993 | Squitieri | |
| 5,455,754 | A | 10/1995 | Hoffner | |
| 5,690,415 | A | 11/1997 | Krehl | |
| 5,758,585 | A | 6/1998 | Latchinian | |
| 5,893,627 | A | 4/1999 | Tague | |
| 6,042,244 | A | 3/2000 | Witkoski | |
| 6,231,205 | B1 | 5/2001 | Slesinger et al. | |
| 6,276,810 | B1 | 8/2001 | Vosshenrich | |
| 6,283,612 | B1 | 9/2001 | Hunter | |
| 6,585,529 | B2 * | 7/2003 | Zakerzewski | F21S 8/06 439/110 |
| 6,720,745 | B2 * | 4/2004 | Lys | A61N 5/0616 315/294 |
| 7,338,180 | B2 | 3/2008 | Wing | |
| 7,348,736 | B2 | 3/2008 | Piepgras et al. | |
| 7,367,685 | B2 | 5/2008 | Moll | |
| 7,600,887 | B2 | 10/2009 | Sherman | |
| 7,614,350 | B2 | 11/2009 | Tuttle et al. | |
| 7,766,502 | B2 | 8/2010 | Tress | |
| 7,806,569 | B2 | 10/2010 | Sanroma et al. | |
| 7,871,176 | B2 | 1/2011 | Kelly et al. | |
| 8,113,678 | B2 | 2/2012 | Babcock et al. | |
| 8,136,956 | B2 | 3/2012 | Oketani et al. | |
| 8,215,795 | B2 | 7/2012 | Pichel | |
| 8,220,953 | B1 | 7/2012 | Moore | |
| 8,348,492 | B2 | 1/2013 | Mier-Langner et al. | |
| 8,490,424 | B2 | 7/2013 | Roche et al. | |
| 8,496,359 | B2 | 7/2013 | Thomas et al. | |
| 8,545,045 | B2 | 10/2013 | Tress | |
| 8,562,167 | B1 | 10/2013 | Meier et al. | |
| 8,704,448 | B2 * | 4/2014 | Tischler | H05B 33/0821 315/185 R |
| 8,974,251 | B2 | 3/2015 | Zong et al. | |
| 8,979,296 | B2 | 3/2015 | Wiemer et al. | |
| 2005/0122665 | A1 | 6/2005 | Daniel | |
| 2006/0209537 | A1 | 9/2006 | Stelmasik et al. | |
| 2008/0043456 | A1 | 2/2008 | Bernardini et al. | |
| 2008/0121146 | A1 | 5/2008 | Burns et al. | |
| 2010/0008072 | A1 | 1/2010 | Meier-Graichen et al. | |
| 2010/0135020 | A1 | 6/2010 | Moore | |
| 2010/0195317 | A1 | 8/2010 | Oketani et al. | |
| 2011/0164399 | A1 | 7/2011 | Driver et al. | |
| 2011/0273867 | A1 | 11/2011 | Horst et al. | |
| 2012/0031964 | A1 | 2/2012 | Thielmann et al. | |
| 2012/0140440 | A1 | 6/2012 | Dam et al. | |
| 2012/0230018 | A1 | 9/2012 | Wiemer et al. | |
| 2012/0274189 | A1 | 11/2012 | Attey et al. | |
| 2013/0107501 | A1 | 5/2013 | Ewald et al. | |
| 2013/0188338 | A1 | 7/2013 | Melhaff | |
| 2013/0242561 | A1 | 9/2013 | Kramer et al. | |
| 2013/0286651 | A1 | 10/2013 | Takeuchi | |
| 2013/0299439 | A1 | 11/2013 | Sid et al. | |
| 2013/0337668 | A1 | 12/2013 | Ernest et al. | |
| 2015/0182038 | A1 | 7/2015 | Wiemer et al. | |

* cited by examiner

DISPLAY LIGHTING SYSTEM

BACKGROUND OF THE INVENTION

The present invention relates to lighting systems, and more particularly to lighting systems having manually moveable and repositionable lighting modules and lighting elements.

In many modern lighting systems, it is desired to have a significant degree of flexibility in a user's ability to control the direction, intensity, and characteristics of light emitted from the system. In retail or commercial settings, track lighting, individual halogen lights, or fixed LED lighting arrays often are used to illuminate merchandise and displays. This lighting can be incorporated into the structure of the building or into individual display units.

While some of these lighting systems are flexible, they suffer shortcomings. For example, many are relatively large in the sense that the fixtures are conspicuous. In some applications, such as jewelry and fine goods displays, it is desirable for the lighting to be as inconspicuous as possible. In another example, the systems can be difficult to adjust or modify for a particular display layout. In some cases, the light fixtures can be relatively heavy or cumbersome. Further, for a store clerk to move, add or remove a light fixture having a mechanical connector, a tool may be required. This can add complexity, time and expense to the modification of a display. In some cases, entirely new electrical connections are required. And even in cases where the light fixture may be rotatably mounted, the base of the fixture typically is only moveable in a single dimension, thereby limiting the degree of adjustability.

To address the difficulty in moving or adjusting light fixtures in systems, some manufacturers have developed low voltage track lighting systems having individual light modules that are moveable along, and that attach directly to, the track. The track includes a magnetic material and first and second electrical strips. The module includes a light mounted directly on a base, a second magnetic material, and first and second electrical contacts that can engage the electrical strips. The module and light can be moved along the track by a user. Although this enhances flexibility, the module itself includes the light, so when the light or module fails, both must be replaced. Further, the track must be precisely oriented to provide a desired illumination from the attached light module light. Many times, the structure of the track or display does not lend itself to such precise orientation, which can lead to an aesthetically displeasing display or unacceptable lighting characteristics. Even further, the track can become marred or scratched upon repeated movement and reattachment of the light module. This can lead to the display having an unsightly or damaged appearance.

SUMMARY OF THE INVENTION

A lighting system is provided including a low voltage frame, a puck magnetically joinable with the frame, a lighting array and an elongated electrical connector joining the puck and the lighting array.

In one embodiment, the low voltage power frame includes an elongated frame body to which first and second low voltage power rails are mounted. Each power rail is constructed from a magnetic material. Optionally the magnetic material is magnetic stainless steel. A hot black oxide coating can be included on the power rails to conceal them yet still protect them from marring and/or scratching due to movement of the puck along the frame.

In another embodiment, the low voltage power frame can include a frame indexing element, such as a slot or a ridge. This feature can be configured to register with a corresponding puck indexing element associated with the puck to ensure that the electrical connectors of the puck correctly match the first and second power rails, which can be of different polarities. Optionally, the puck indexing element can be offset laterally from a longitudinal axis of the puck so that the electrical connectors reduce orientation error and correctly position the puck.

In still another embodiment, the lighting array can include multiple lighting elements, and can be connected to a flexible electrical coupler. The electrical coupler can be electrically coupled to a power feed of the puck as well, enabling the puck and lighting array to be distal from one another to provide suitable placement of each. The coupler can transfer power from the puck to the light array to illuminate the lighting elements when the puck is joined with the low voltage frame via a magnetic force.

In yet another embodiment, the puck can include a puck body constructed from a molded polymeric material. The polymeric material can be molded over multiple components of the puck, such as a power feed and first and second puck electrical connectors, which optionally can be in the form of plates. The molded over material can enable the puck and its components to be rugged and reliable, with minimal risk of disrupting electrical communication between those components.

In even another embodiment, the puck electrical connectors can be in the form of one or more plates. Each plate can include an upper portion and a lower portion. The upper plate portion can be embedded and encapsulated within the molded polymeric material of the puck body so that the first plate upper portion is concealed. The lower plate portion can extend out from an underside of the puck body.

In a further embodiment, the puck can include one or more magnetic elements adjacent and magnetizing at least one of the puck electrical connectors so that the connectors magnetically attract to the power rails of the low voltage power frame, thereby physically joining the puck with the low voltage frame via a magnetic force.

The current embodiments provide a lighting system that is easily installed, serviced, replaced and repositioned. With the puck being moveable along and relative to the low voltage frame, a low skilled user can easily orient and reorient a lighting array powered through the puck relative to merchandise or other items. Because the puck attaches to the low voltage frame via magnetic force, no additional tools are required to move the puck. Further, with the electrical connectors of the puck being magnetized, the user can be assured that as long as the puck is attached to the frame, there will be power to the lights of the lighting array. In addition, no significant design changes are needed in the system to move the lighting array and/or puck around to different locations on the display. Also, the design is resistant to damage. If the array or coupler is inadvertently pulled, the force from the pulling can overcome or disrupt the magnetic forces holding the puck to the low voltage frame, enabling the puck to simply disconnect from the frame without damage to either.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
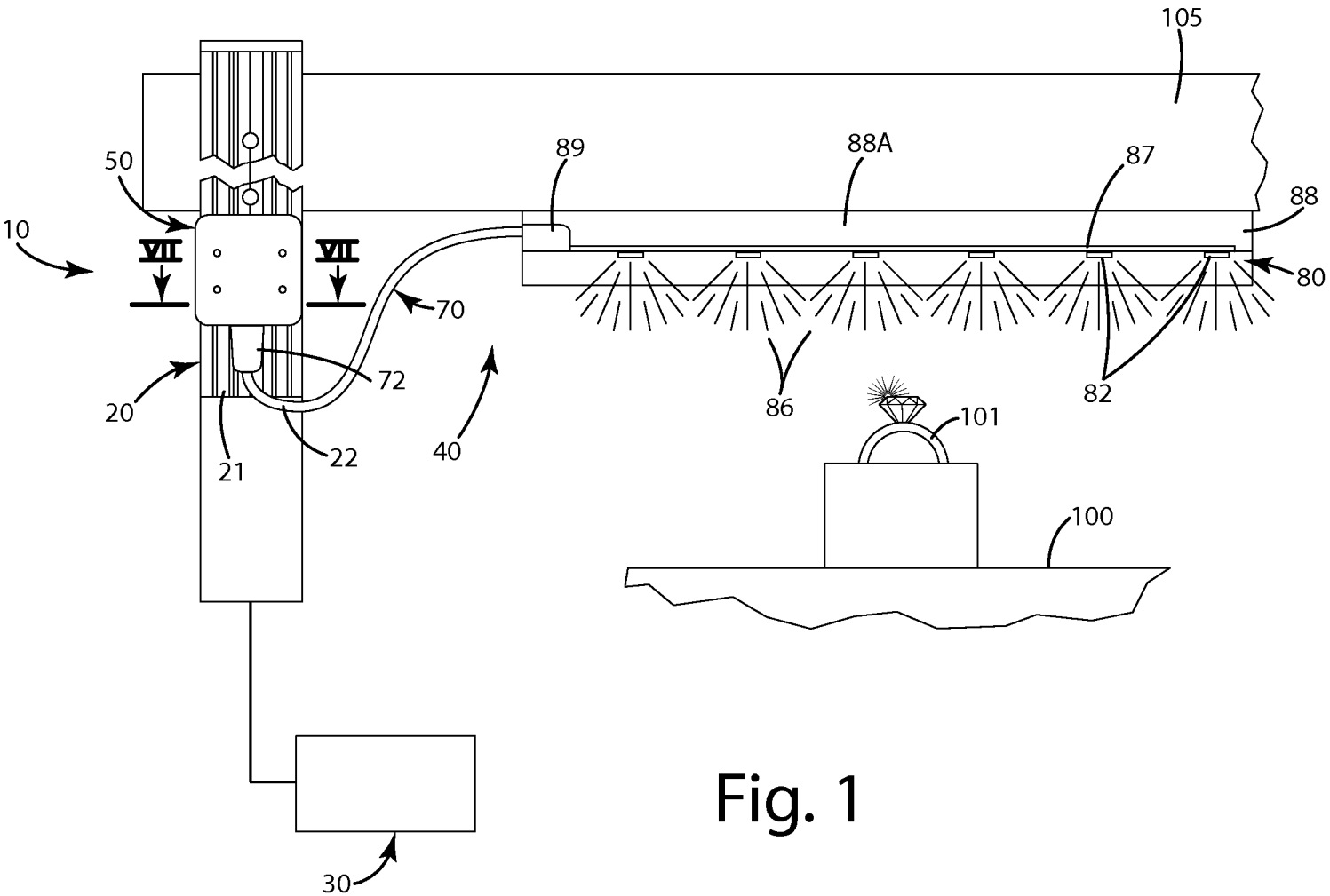
FIG. 1 is a schematic illustrating the lighting system of the current embodiment implemented in a display unit.
Figure 2:
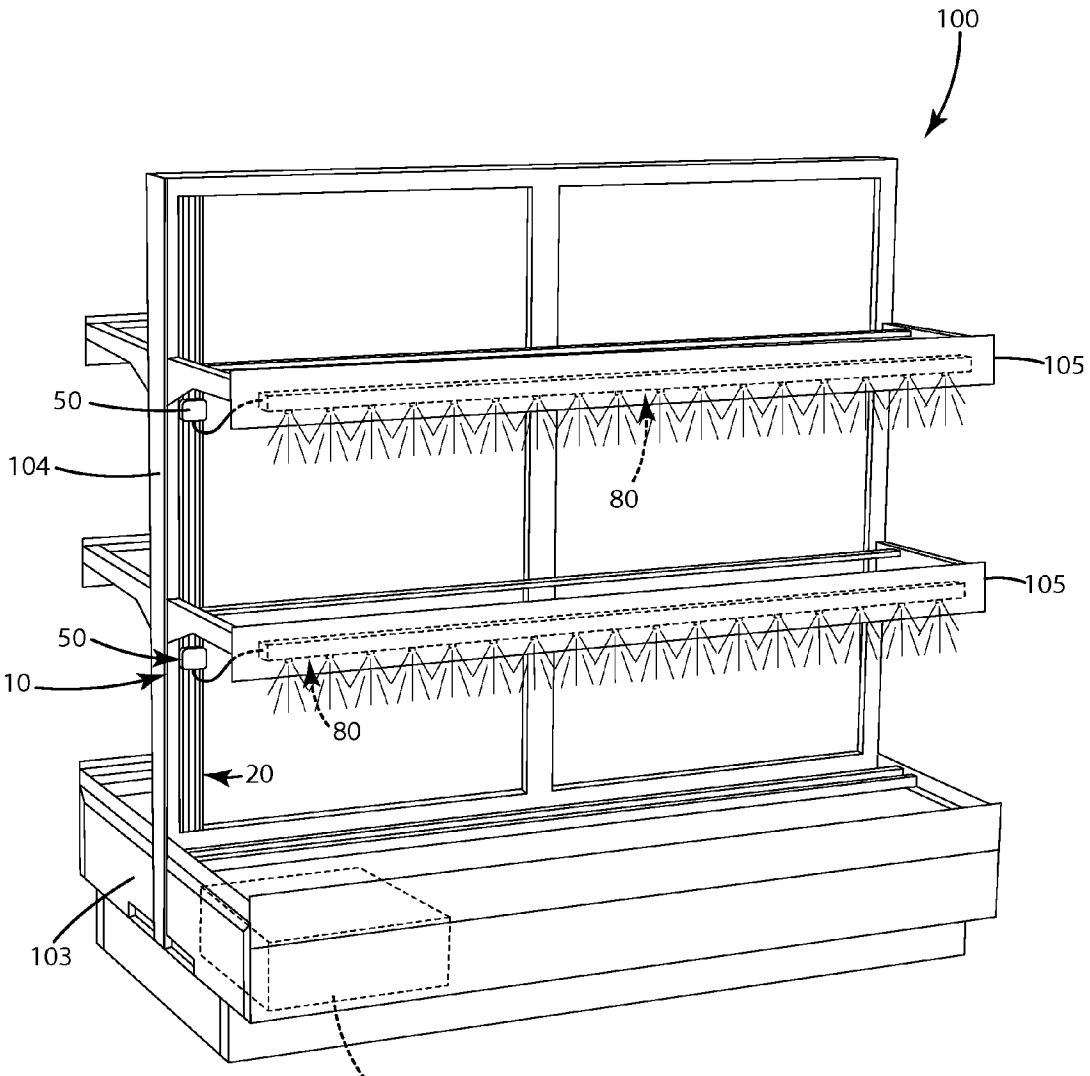
FIG. 2 is a perspective view of the display unit including the lighting system.

A lighting system of a current embodiment associated with a display unit is illustrated in FIGS. 1-2 and generally designated 10. The lighting system 10 can include a low voltage power frame 20 that is coupled to a power source 30. A movable light module 40 including a puck 50, an electrical coupler 70 and a lighting array 80 can be oriented with the puck 50 selectively and movably attached to the low voltage power frame 20. The puck 50 can be moved vertically along the frame to establish electric communication between it and the power frame as described in further detail below.

Generally, the puck is held to the frame only via a magnetic force that can be overcome by manual force of a user, so that the puck can be moved to another section of the frame. The coupler 70 can extend from the puck 50 to the light array 80, thereby establishing electrical communication between the puck and the light array 80. In this manner, electricity can be transferred from the power frame 20, to the puck 50, through the coupler 70 to the lighting array 80 ultimately to the lighting elements 82, which emit illumination 86 on an article 101 located on the display unit 100. The lighting module 40 is easily reoriented or moved to provide adequate placement of the lighting array 80 on preselected portions of the display unit 100, and accompanying lighting variations.

As shown in FIG. 2, the display unit is generally in the form of retail shelving including a base cabinet 103, a vertical support 104 extending upwardly therefrom, and one or more shelving units 105. Shelving units are vertically displaceable along the vertical support 104 to provide adequate clearance between them or to otherwise provide a desired display effect. The pucks 50 of each of the respective lighting modules 40 can be disposed adjacent respective shelves 105. The lighting arrays 80 can illuminate articles located under the respective shelves 105 and supported by a next lower shelf.

While the current embodiments are described in conjunction with a display unit including multiple shelves, the lighting system can also be used in a variety of different applications. For example, it can be used to illuminate vertical wall boards, wall displays, pictures, closet space, interior space, rooms of buildings or other structures, or virtually any other application requiring illumination of merchandise or other items. The lighting system can be implemented in commercial or retail applications as shown herein, or in military, agricultural, industrial and/or residential applications. Generally, the lighting system also can be used on vehicles, such as automobiles, trucks and equipment.

As shown in FIG. 2, the display unit includes a base 103. Within the base, a power source 30 can be disposed. The power source 30 can provide AC or DC power to the low voltage frame 20. In the case of AC power, there can be a coupling to a local AC power source within the building in which the display unit 100 is disposed. If the power is from a local DC power source, there can be an interface for local DC power, or it can include an AC to DC power converter. Such DC power supply can include a transformer, a voltage and/or current controller and a load stabilizer. Optionally, the power source 30 can be configured for the addition and/or removal of one or more lighting modules without the interruption or changes in the overall powering of the system. The power source 30 can be positioned anywhere that enables it to be conductively coupled to one or more power rails 21, 22 of the power frame 20.

Figure 3:
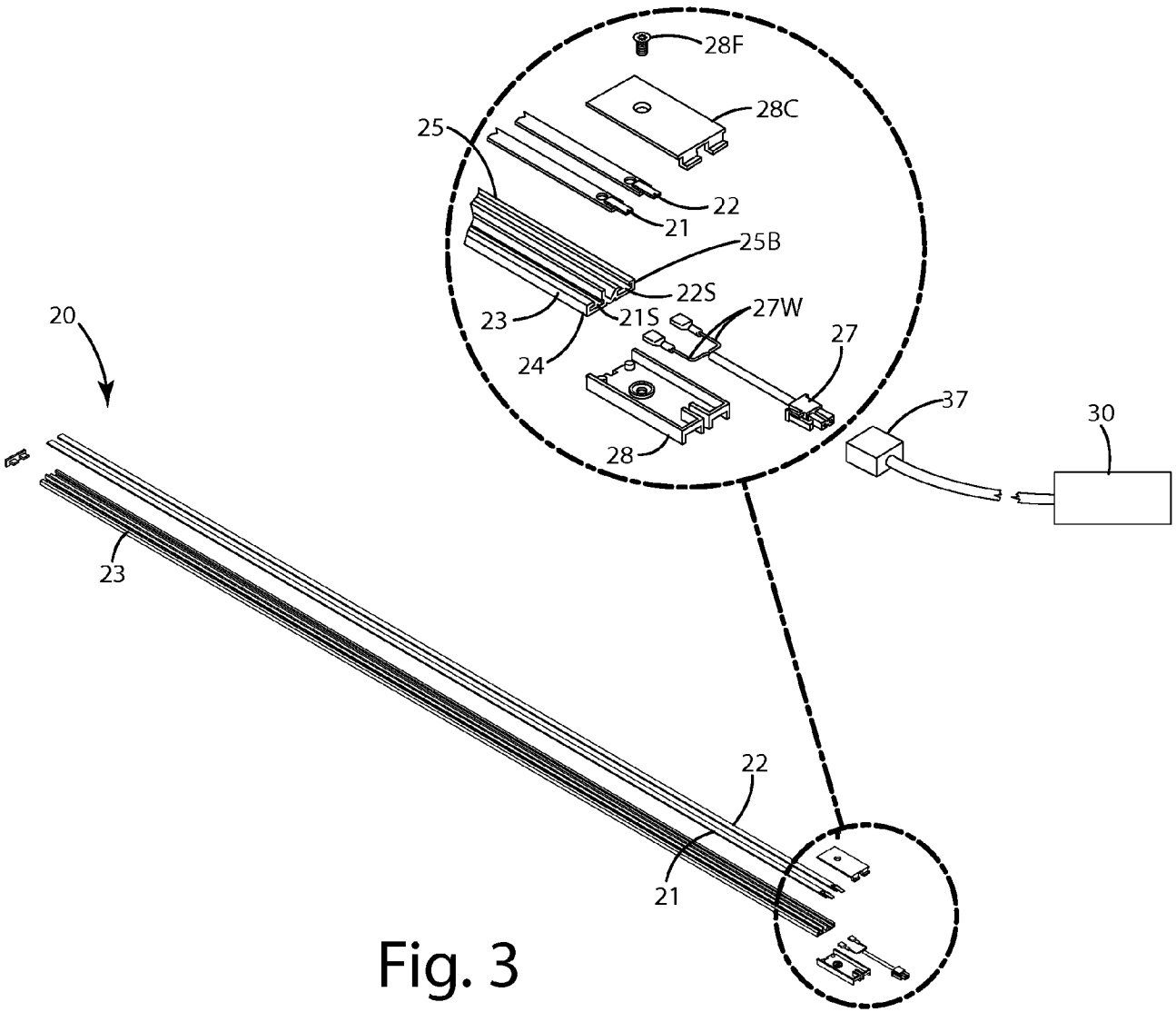
FIG. 3 is an exploded view of a low voltage power frame of the lighting system.

As mentioned above, the power source is electrically coupled to the low voltage power frame 20. The low voltage power frame 20 as shown in FIGS. 2 and 3 can be in the form of an elongated element that can be oriented generally vertically relative to the display unit 100. Optionally, the low voltage power frame can extend up a single end or side of the vertical support 104. This effectively can provide a low voltage power supply anywhere along the vertical extent of the display unit 100. Further optionally, although not shown, the frame can be oriented horizontally relative to the display unit 100, for example, sideways, along the support wall or along a shelf.

As shown in FIG. 3, the power frame 20 can include first and second power rails 21 and 22 that are mounted to an elongated frame body 23. This elongated frame body 23 includes a mounting surface 24 which is adapted to mount to a surface of a display unit, for example, the front surface of the vertical support wall 104. By being adapted to mount to a surface, the elongated frame body 23 can be outfitted with an adhesive backer, fasteners, such as screws, rivets or bolts, or other mechanical fasteners that enable the mounting surface 24 to face toward the surface of the vertical support wall or other surface of the unit.

Figure 6:
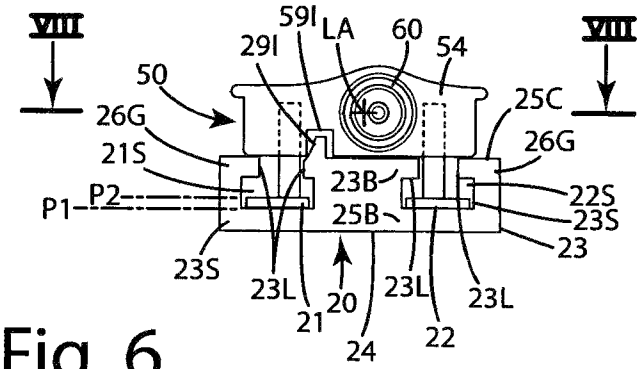
FIG. 6 is a front view of the puck of the lighting system secured to the power frame track under magnetic force to establish electrical communication between the puck and power rails of the low voltage power frame.

The elongated frame body 23 can also include a front surface 25 that is opposite the mounting surface 24. The front surface can include first and second slots, openings or recesses 21S and 22S defined along a bottom of the front surface 25. These slots 21S and 22S can be configured to receive and retain the respective first 21 and second 22 power rails of the frame. The first and second power rails can be disposed adjacent the bottom 25B of the front surface of the elongated frame body 23. As further shown in FIG. 6, the slots 21S and 22S can be of a rectangular shape with an open upper surface that is immediately adjacent the front contact surface 25C of the frame body 23. It is this contact surface 25C that generally engages the underside of the puck 50 as further described below. As shown in FIG. 6, the power frame 23 also can include one or more guiderails 26G which are disposed along the first and second sides 23S of the power frame. These guiderails 26G can be configured to engage the undersurface of the puck 50 and so that the guiderails project upwardly from a bottom 25B of the power frame 23. The power frame slots 21S and 22S can be constructed so that they include edges or lips 23L that extend inwardly toward one another or toward the longitudinal axis LA, to reduce the size of the slots 21S and 22S that open to the exterior of the power frame. In this manner, the slots can retain the first and second power rails 21 and 22 within them. Thus, the power rails are physically restrained by the lips. The slots can be of a predetermined depth so that the power rails fit within them and can be easily installed and assembled therein.

The power frame elongated body 23 can be formed from any polymeric, plastic or other insulating material. Optionally, it can be molded or extruded when being formed. The power frame can be configured so that the slots 21S, 22S include bottoms that generally lay within a single common plane P1. Optionally, when the first 21 and second 22 rails are disposed in the slots, they too lay in a single common plane P2. Generally, this common plane can be parallel to the mounting surface 24 of the power frame 20 as shown in FIG. 6.

As shown in FIG. 3, the power frame 23 can include an electrical coupler 27 that couples to a corresponding coupler 37, which is further coupled to the power source 30. The power frame coupler 27 can include one or more wires 27W which include connectors that connect directly to the first and second power rails 21 and 22. The power frame can include an end cap 28 that protects the coupler 27 and wires 27W. The end cap 28 can be covered by or closed by a cover plate 28C which generally can be fastened to the end cap using a fastener 28F. The fastener 28F can be in the form of a mechanical fastener such as a screw bolt, rivet or other suitable construction.

As mentioned above, the power rails 21 and 22 are generally disposed within the power frame 23. Each of the rails can be isolated from one another via a centerblock or portion 23B of the power frame. The power rails can be of different polarities. For example, one can be a positive polarity and the other can be a negative polarity. These respective power rails, as mentioned above, can be attached via specific dedicated wires 27W to a coupler 27 that is ultimately further connected to the coupler 37 and power supply 30. The power supply 30 can provide a low voltage current to the power rails 21, 22, optionally from about 4 volts to about 48 volts, further optionally about 6 volts to about 24 volts, depending on the particular application to the respective rails.

The power frame can be of any desired length, depending on the particular application. In some cases, where the power frame is adapted to run along the length of a wall, for example at the top or bottom of the wall, the power frame can be in lengths ranging from 1 foot to 20 feet or more, depending on the particular application.

The power rails 21, 22 can be constructed from a metal material, optionally in the form of elongated strips of electrically conductive material. It has been discovered, however, that due to repeated use and engagement with connectors of the puck, the power rail material can frequently wear out, become marred or scratched and generally present an unsightly appearance when in a display setting. To address the scratching and marring of the power rails, magnetic stainless steel was found to be surprisingly well suited for construction of the power rails. For example, ferritic and martensitic stainless steels can be utilized. One example of a suitable magnetic stainless steel is Grade 430 ferritic steel, which is available from Harbor Steel of Muskegon, Mich. Of course, in other applications, other types of magnetic materials, such as steel or other iron containing alloys and metal structures can be utilized depending on the application.

To address the marring, it was further discovered that treating the power rails so that they include a coating of black oxide allowed the stainless steel to remain magnetic enough to enable the puck to be attracted thereto, yet prevented the power rails from becoming marred or scratched, and yet still allow adequate transfer of electrical current from a power rail to the puck, optionally so that the lighting elements do not flicker or fail to light. The black oxide coating or layer can range in thickness, optionally from about 0.1 microns to about 3.0 microns, further optionally, less than 3 microns, even further optionally about 2.5 microns, or other thicknesses depending on the application. In some embodiments, it was discovered that a hot black oxide coating withstood marring and/or scratching, yet still transfer electrical current to the puck under repeated testing. The hot black oxide coating can be applied by providing a hot path of sodium hydroxide, nitrates and nitrites at about 285° F. to convert the surface of the magnetic stainless steel material into magnetite (FE304). Water can be periodically added to the path with proper controls to prevent a steam explosion. The material is usually dipped in tanks that contain, in order, an alkaline cleaner, water, caustic soda at 140° C. (the black compound) and finally a sealant which can be oil. The caustic soda bonds chemically to the surface of the metal material, creating a porous base layer on the part. Oil can be applied to the heated part which seals it by sinking it into the applied porous layer. Optionally, the oil can prevent the corrosion, scratching or other damage to the work piece. Various specifications for hot black oxide are provided in MIL-DTL-13924, AMS 2485, ASTM D769 and ISO 11408.

In some applications, the mid-temperature block oxide coatings can be utilized in place of a hot black oxide coating. Mid-temperature black oxide coatings blacken at a temperature of about 220° to 245° F., which is a lower temperature than the hot black oxide temperatures. Mid-temperature black oxides can be applied using military specifications MIL DTL 13924 as well as AMS 2485. Optionally, in some applications where it is acceptable to have the power rails mar or scratch—for example where the power rails are completely out of view of a consumer or an environment where the aesthetics do not matter, the power rails can be bare, without any type of coating other than perhaps an optional paint, enamel or other thin film that does not impair or inhibit the magnetic properties of the power rails, and still allows adequate transfer of electrical current from a power rail to the puck. Further optionally, in other applications, the contact surfaces of the power rails can be coated or treated using electrolytic nickel plating, zinc with black chromium plating and/or other coating or plating.

As mentioned above and shown in FIGS. 1-3, the lighting module 40 can include a puck 50 which is connected to a lighting array 80 via an electrical coupler 70. The lighting array 80 can include multiple lighting elements 82. The lighting elements 82 can be in the form of light emitting diodes (LEDs and/or OLEDs), low voltage incandescent bulbs, low voltage halogen bulbs, or other lighting elements depending on the particular application and desired lighting intensity. As illustrated, the lighting elements 82 can be in the form of the LEDs. These LEDs are connected in series or in parallel along a board or other substrate 87. Optionally, the lighting array 80 can include a resistor or other electrical elements to modulate and control the illumination 86 provided by the lighting elements 82. The board or substrate 87 can be further mounted to a housing 88 which can be affixed directly to a shelving unit 105 as shown in FIG. 1. This fastening can be via an adhesive 88A that is disposed between the base 88 and the shelving unit 105. Alternatively, the base 80 can be screwed, fastened or otherwise joined directly to the shelving unit 105. The board or substrate 87 to which the lighting elements are attached can include lighting array connectors 89. These lighting array connectors 89 can be joined with the electrical coupler 70 which is further electrically coupled to the puck 50.

The electrical coupler 70 can be in the form of wires that are wrapped in a sleeve to prevent the wires from inadvertently contacting one another or other grounding elements. The wires and the electrical coupler can be flexible, so that they can be moved about and flexed, thereby enabling the puck 50 to move in various orientations relative to the lighting array 80. The flexible coupler can be anywhere from 3 inches to about 2 or 3 feet or more, depending on the particular application. Generally, the flexible coupler is of a sufficient length so that the puck 50 is distal from and independently orientable relative to the lighting array 80. In this manner, the puck can be mounted to the power frame 20 without regard to the orientation of the lighting array 80 to the shelving unit 105 and/or the display 100.

Figure 5:
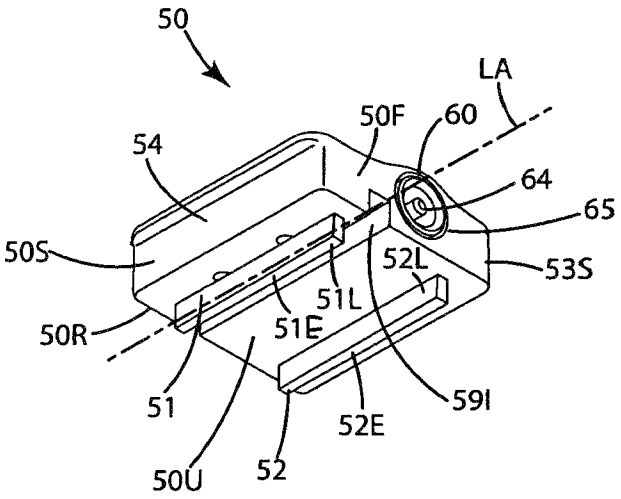
FIG. 5 is a lower perspective view of the puck of the lighting system.
Figure 4:
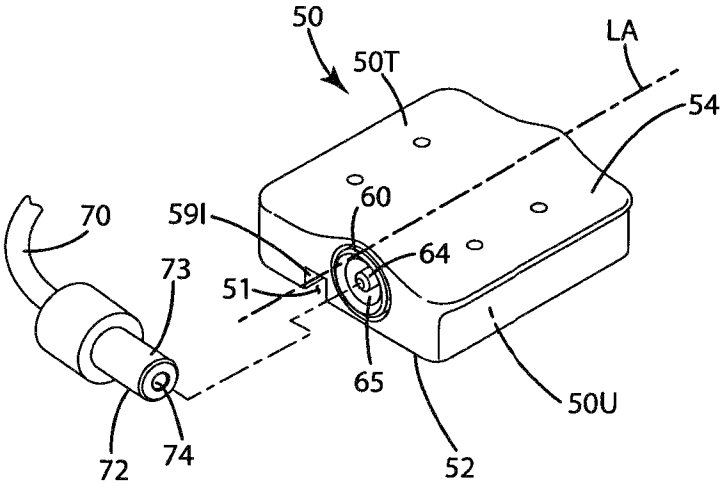
FIG. 4 is an upper perspective view of a puck of the lighting system.

The electrical coupler can terminate at a connector end, optionally in the form of a cable jack. The connector end, in the form of a cable jack 72, can be configured to connect with a power feed 60 of the puck 50 as shown in FIGS. 4 and 5. The connector end 72 can include an elongated, cylindrical projection 73 defining an internal bore 74. The elongated, cylindrical projection 73 can fit within the barrel 65 of the power feed 60. A pin 64 of the power feed 60 can fit within the elongated bore 74 of the connector end 72.

As illustrated in FIGS. 4 and 5, the polarity pin 64 and the barrel 65 of the power feed 60 can be laterally offset from the longitudinal axis LA of the puck body. In some cases, the power feed is closer to the second side 53S than it is to the first side 50S of the puck body. Although shown as opening outward from the front side 50F of the puck body, the power feed, and in particular the barrel could open from other surfaces, such as the front, the rear, the top of the underside or even the underside where there is sufficient room.

Optionally, the power feed 60 can be offset laterally from the longitudinal axis LA, and can be closer to the second puck electrical plate then to the first puck electrical plate. Of course, if desired, the power feed and its respective barrel can be equidistant from both of the electrical plates, and symmetrically disposed in the center of the puck body. Further optionally, the barrel although offset from the longitudinal axis, the barrel can be substantially parallel to the longitudinal axis if desired. Although shown as a cable jack, the power feed can take alternative forms. For example, the power feed can be in the form of a USB port or plug, connectable to the coupler 70 with corresponding structure. As another example, the power feed can be in the form of a socket or prongs, also connectable to the coupler 70. Additional examples of a power feed alternatives include 2-pin or multipin interlocking plugs, coaxial connectors, coated wire whip or wire whip with connector.

Figure 8:
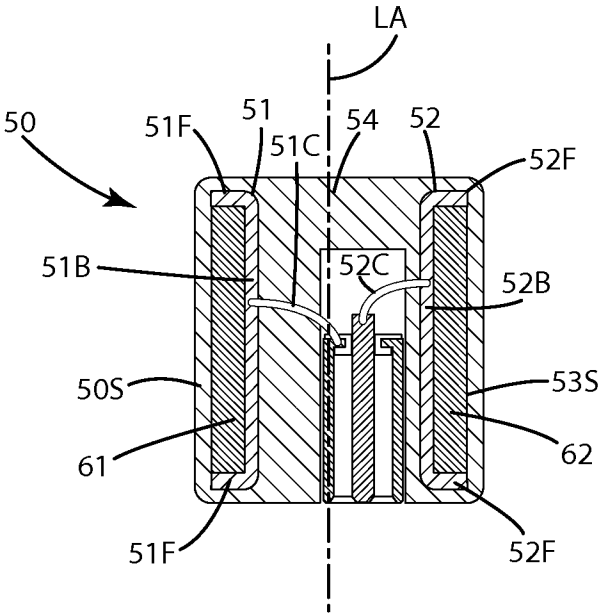
FIG. 8 is a second cross section of the puck taken along lines VIII-VIII of FIG. 6.

Generally, the power feed 60 of the puck 50 can be embedded and/or encapsulated within a polymeric material that comprises the puck body 54. The power feed 60 can be oriented so that the polarity pin in the center of the barrel is of a positive polarity and the barrel itself is of a negative polarity. The pin can be connected to a second puck electrical element such as a plate 52 as shown in FIG. 8. The barrel with its negative polarity can be connected to a first puck electrical element 51, which also is in the form of a plate as shown in FIG. 8. This connection can be via first 51C and second 52C puck electrical connectors that join the respective portions of the power feed and their polarities to the respective puck electrical elements.

As shown in FIGS. 1, 4-8, the puck of the lighting module 40 can be of a small, rectangular shape that is easily grasped and moved. The puck 50 can be moved vertically anywhere along the power frame 20 by a user. The user can disconnect the puck 50 from the power frame simply by exerting enough physical force to overcome the magnetic force that holds the electrical elements to the respective power rails. This amount of physical force needed can range from about 0.1 pounds to about 5 pounds, optionally about 0.25 pounds to about 1 pound, depending on the types of magnets used and materials of the power rails.

The puck as shown in FIG. 4-8 can include a first lateral side 50S and a second lateral side 53S opposite the first side 50S. The puck body itself can be constructed from a molded polymeric material, such as a plastic, HDPE, PE, ABS, nylon, or other materials. Optionally, this body can be impregnated with reinforcing fibers or filaments, and/or composite materials to add to its strength, rigidity and insulative properties. The molded polymeric material can be nonconductive so that it will not convey voltage from the first power rail to the second power rail or vice versa. The molded polymeric material of the puck body holds all of the different components in a fixed, rigid, immovable configuration relative to one another. Because the material is molded over and encapsulates all the different components, they virtually do not move relative to one another during the useful and functional life of the puck. Where there are different electrical connectors between the components, this can substantially prolong the life of those components.

The puck body 54 also can include a front side 50F and rear side 50R that oppose one another. The respective front and rear sides can merge into the first lateral side and second lateral side. The puck also can include an upper or top side 50T and an underside 50U. The puck body also can define a longitudinal axis LA which generally bisects the puck into left and right lateral portions of substantially equal widths. The longitudinal axis can be parallel to the left and right sides 50S and 53S of the puck, and substantially perpendicular to the front 50F and rear 50R sides thereof. Between the top surface and the underside, the power feed 60 and portions of the puck electrical connectors 51 and 52 can be disposed.

Figure 7:
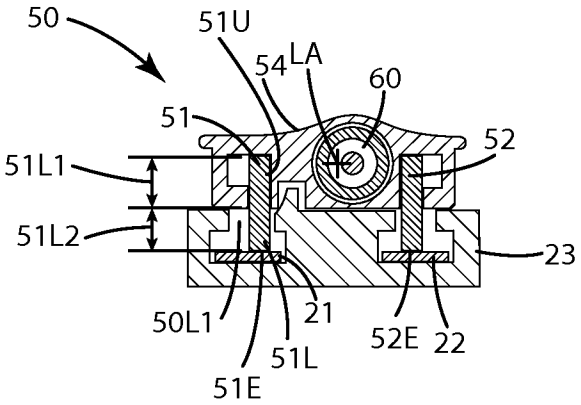
FIG. 7 is a section view of the puck and low voltage power frame taken along lines VII-VII of FIG. 1.

As shown in FIGS. 5 and 7, the puck 50 includes a first puck electrical connector 51 and a second puck electrical connector 52. These are the components that generally facilitate transfer of electricity or voltage through the power feed from the power rails when the first and second electrical connectors engage, or otherwise touch, or come into electrical proximity to the respective power rails. The electrical connectors 51, 52 can be in the form of plates. The plates can extend generally and parallel to the longitudinal axis LA of the puck body 54. The plates themselves can be constructed from magnetizable or magnetic material, such as steel or other iron containing material.

Each of the respective puck electrical connectors 51 and 52 are in electrical communication with the power feed 60 and respective polarities via the first and second power feed electrical connectors 51C and 52C. Each of the respective connector plates 51 and 52 can include an upper portion 51U and a lower portion 51L as shown in FIG. 7. The upper portion 51U can be substantially encapsulated and embedded within the polymeric material of the body 54 of the puck 50. For example, its front and rear sides can be substantially encapsulated and physically bonded to the polymeric material within which it is disposed. The same can be true for the upper plate portion 52U of the second puck electrical connector 52.

The upper portion 51U can be of a first predetermined length 51L1. Along this length, the upper portion 51U can be substantially disposed within the puck body 54. The lower plate portion 51L can extend a second length or distance 51L2 from the underside 50U of the puck body 54. This length or distance 51L2 can be less than the distance 51L1 if desired. Optionally, the distances 51L1 and 51L2 could be substantially the same. In some embodiments, the distances 51L1 and 51L2 can be about 0.1 mm to about 10 mm, further optionally about 1 mm to about 5 mm, or other distances depending on the particular application.

The connector plates 51 and 52 can include one or more flanges 51F. With these flanges, the main body 51B of the plate 51 can generally cooperatively form or define a channel. As illustrated in FIG. 8, the channel can face outward or away from the longitudinal axis LA of the puck body, generally opening outward toward the sides 50S and 53S. As shown in FIG. 8, within the channel defined by the flanges 51 and main plate 51B, a magnetic element 61 can be disposed. Another, separate magnetic element can be positioned in the channel defined by the flanges 52F and main body 52B of the second puck electrical plate 52. Optionally, the magnetic elements 61 and 62 can be any type of suitable magnet, optionally neodymium magnets, ceramic magnets or other magnetic material. The magnets transfer magnetic forces through and magnetize the respective plates 51 and 52. With this magnetization, the exposed lower plate portions 51L and 52L are magnetized. Therefore, they magnetically attract to other magnetic material, which is the case when the puck is positioned adjacent the low voltage power frame 20. Specifically, the respective lower portions 51L and 52L, being magnetized by the respective magnetic elements 61 and 62, attract to the respective power rails 21 and 22, thereby attaching the puck to the power rails substantially only via a magnetic force. In some cases, there can be additional frictional elements or other physical structures that assist in attaching the puck body to the power frame, but optionally the same is not included to avoid additional cost, expense and complication for such an attachment.

As shown in FIGS. 7 and 8, the magnetic elements 61, 62 are disposed between the electrical plates 51, 52 and the respective sides of the puck body. For example, the first magnet 61 is disposed between the main body 51B of the first plate 51 and the side 50S of the puck body. The second magnet 62 is disposed between the second puck electrical plate 52 and the second side 53S. Of course in certain applications, the magnets can be disposed closer to the longitudinal axis LA than the plates. In this case, the puck may be widened to accommodate the magnets being closer to the power feed 60 than the respective electrical connector plates.

The first and second electrical plates can terminate in first and second bottom edges 51E and 52E. These edges 51E and 52E can directly engage the respective first and second power rails 21, 22. The edges can be substantially flat as shown, or they can be rounded, without any sharp edges, that might otherwise scratch or mar the respective power rails. With no moving parts in the puck body, it generally can be more reliable and less prone to excessive wear than other types of connectors having movable components.

The puck 50 and power frame 23 can include respective indexing elements as shown in FIGS. 5-7. There, the power frame 23 can include a frame indexing element 29I that projects upwardly from the center block or portion 23B of the power frame. This indexing element 29I can be in the form of a ridge that projects upwardly a preselected distance from the upper surface of the block 23B. The puck body 54 can define a corresponding puck indexing element 59I which, as illustrated, can be in the form of an elongated slot extending along the underside 50U of the puck body 54. The elongated slot can generally extend perpendicular to the front 50F and rear 50R of the puck body. The elongated slot can extend substantially parallel to the longitudinal axis LA as well as the first and second sides 50S and 53S. Optionally, the indexing element 59I of the puck and the indexing element 29I of the frame are offset laterally from the longitudinal axis LA of the puck body 54. This is so that the respective first and second plates are coupled with the proper polarity first and second power rails. Generally, the indexing elements can be in the form of a mating male/female components to verify the polarity of mating before the plates touch the power rails of the frame. The indexing elements, and optional offsets, can ensure that the first electrical connector plate aligns with the first power rail but not the second power rail of the low voltage power frame. Conversely, the registration of the indexing elements 29I and 59I also can ensure that the second electrical connector plate aligns with the second power rail, but not the first power rail of the low voltage power frame. In this manner the polarity can be proper with every placement of the puck along the power frame absent some significant modification of either the frame or the puck. In this manner, the user can readily and easily and consistently attain an electrical connection between the low voltage power frame and the puck, and thus properly power the lighting array 80.

In general, a user can utilize the lighting system 10 of the current embodiments as follows. First, a user can set up the display unit 100 as shown in FIG. 2 with the respective shelves 105 positioned in desired locations. With the shelves so located, the user can then connect a lighting array 80 to the respective undersides of the shelves so the lighting array will illuminate items on the next lower shelf. With the lighting array so positioned, a user can connect the puck, with its flexible electrical connector coupled to the lighting array, to the low voltage power frame 20. Generally, the user will attempt to place the puck immediately under the shelf so that it is less visible. Of course, where the colors of the power frame and the puck match, for example both are black, this may not present much of an aesthetic issue. When the user places the puck and in particular the electrical connector plates extending out from the underside of the puck (which are magnetized) near the power rails, the plates magnetically attract to the respective power rails. The respective indexing features or elements 29I and 59I will meet with one another when the appropriate plates are aligned with the appropriate power rails. This can ensure that the polarity is properly transferred.

With the puck oriented and disposed on the power frame, the plates are magnetically held with a magnetic force in position. No tools are used to join the puck and the low voltage frame and no moving parts are present to make the connection between the puck and the low voltage frame. When the puck is desired to be removed from the low voltage frame, a user can simply apply force to overcome or disrupt the magnetic force attracting the puck to the power rail and remove the puck. In this manner, the shelf can be adjusted and removed and the electrical connection disrupted and established between the lighting array and low voltage power frame quickly and easily, generally without the use of tools.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A lighting system comprising:

a low voltage power frame comprising:

an elongated frame body, the elongated frame body having a mounting surface adapted to mount to a surface of a display unit and a front surface opposite the mounting surface, the front surface including a bottom;

a first power rail and a second power rail disposed adjacent the bottom of the front surface, each of the first and second power rails being constructed from a magnetic material;

a frame indexing element associated with the front surface of the elongated frame body;

a lighting array comprising a plurality of lighting elements;

a puck comprising:

a puck body constructed from a molded polymeric material, the puck body including a longitudinal axis, the puck body being separate and distal from the lighting array;

a power feed mounted to the body;

a first puck electrical plate including a first plate upper portion and a first plate lower plate portion, the first upper plate portion embedded and encapsulated within the molded polymeric material of the puck body so that the first plate upper portion is concealed, the first plate lower portion extending out from the underside of the puck body, the first puck electrical plate electrically coupled to the first electrical connector of the power feed, a second puck electrical plate distal from the first puck electrical plate and including a second plate upper portion and a second plate lower portion, the second plate upper portion embedded and encapsulated within the molded polymeric material of the puck body so that the second plate upper portion is concealed, the second plate lower portion extending out from the underside of the puck body, the second puck electrical plate electrically coupled to the second electrical connector of the power feed, a magnetic element adjacent and magnetizing at least one of the first puck electrical plate and the second puck electrical plate so that at least one of the first puck electrical plate attracts to the first power rail and the second puck electrical plate attracts to the second power rail, thereby physically joining the puck with the low voltage frame via a magnetic force;

a puck indexing element associated with the puck body and adapted to register with the frame indexing element so as to ensure the first puck electrical connector plate engages the first power rail and the second puck electrical connector plate engages the second power rail; and an electrical coupler electrically coupled to the power feed of the puck and the lighting array so that power can be conveyed from the puck to the light emitting diodes to illuminate the light emitting diodes when the puck is joined with the low voltage frame via the magnetic force.

2. The lighting system of claim 1, wherein the puck indexing element is an elongated slot defined by the underside of the puck body, wherein the elongated slot extends adjacent but offset from the longitudinal axis.

3. The lighting system of claim 2 wherein the frame indexing element is an elongated raised ridge configured to selectively interfit within the elongated slot of the puck when the first electrical connector plate is aligned with the first power rail.

4. The lighting system of claim 3 wherein the power feed is a cable jack defining a barrel and a pin is coaxially disposed within the barrel.

5. The lighting system of claim 2 wherein the first and second puck electrical plates are disposed on opposite sides of the longitudinal axis, with the first puck electrical plate being closer to the elongated slot than the second puck electrical plate.

6. The lighting system of claim 1 wherein the power frame includes a first track in the bottom within which the first power rail is disposed and a second track in the bottom within which the second power rail is disposed.

7. The lighting system of claim 1 wherein the magnetic material is a magnetic stainless steel including a black oxide coating.

8. The lighting system of claim 1 wherein the first power rail and the second power rail lay in a single common plane.

9. A puck for a lighting system having a low voltage frame and a lighting array, the puck comprising:

a puck body constructed from a molded polymeric material, the puck body including a longitudinal axis and an underside;

a power feed including first and second electrical connectors mounted to the body;

a first puck electrical plate including a first plate upper portion and a first plate lower plate portion, the first upper plate portion embedded and encapsulated within the molded polymeric material of the puck body so that the first plate upper portion is concealed, the first plate lower portion extending out from the underside of the puck body, the first puck electrical plate electrically coupled to the first electrical connector of the power feed, a second puck electrical plate distal from the first puck electrical plate and including a second plate upper portion and a second plate lower portion, the second plate upper portion embedded and encapsulated within the molded polymeric material of the puck body so that the second plate upper portion is concealed, the second plate lower portion extending out from the underside of the puck body, the second puck electrical plate electrically coupled to the second electrical connector of the power feed, a first magnetic element embedded and encapsulated within the molded polymeric material of the puck body, the first magnetic element magnetizing the first puck electrical plate, whereby the first puck electrical plate attracts to the low voltage power frame, thereby physically joining the puck with the low voltage frame substantially only via a magnetic force; and a puck indexing element in the form of an elongated slot defined by the underside of the puck and adapted to selectively register with the low voltage frame to ensure the first puck electrical plate orients in alignment with only a first power rail of the power frame, the elongated slot being offset from the longitudinal axis and closer to the first puck electrical plate than the second puck electrical plate.

10. The lighting system of claim 9 comprising a second magnetic element embedded and encapsulated in within the molded polymeric material of the puck body, the second magnetic element magnetizing the second puck electrical plate, whereby the second puck electrical plate attracts to the low voltage power frame, thereby further physically joining the puck with the low voltage frame substantially only via a magnetic force, wherein the first magnetic element and the second magnetic element are disposed on opposite sides of the longitudinal axis.

11. The lighting system of claim 9 wherein the power feed is a cable jack defining a barrel, wherein a pin is coaxially disposed within the barrel.

12. The lighting system of claim 11, wherein the cable jack is embedded and encapsulated by the molded polymeric material of the puck body, wherein the cable jack is offset laterally from the longitudinal axis and closer to the second puck electrical plate than to the first puck electrical plate.

13. The lighting system of claim 11 wherein the first puck electrical plate includes flanges and a main plate that cooperatively define a channel, wherein the first magnetic element is disposed within the channel.

14. The lighting system of claim 11 wherein the puck body includes a first side and a second side, opposite the first, wherein the first magnetic element is disposed between the first puck electrical plate and the first side of the puck body.

15. The lighting system of claim 14 comprising a second magnetic element disposed between the second side and the second puck electrical plate.

16. The lighting system of claim 11 wherein the first puck electrical plate and the second puck electrical plate each include a first bottom edge and a second bottom edge, respectively, wherein each of the first bottom edge and second bottom edge are disposed a preselected distance below the underside of the puck body, and wherein the first bottom edge and second bottom edge are adapted to each form an electrical contact with a power rail of the low voltage frame.

17. The lighting system of claim 16 wherein the first and second bottom edges, and the first and second puck electrical plates are fixedly attached to and immovable relative to the puck body.

18. A lighting system for a display unit, the lighting system comprising:

a low voltage power frame comprising:

an elongated frame body, the elongated frame body having a mounting surface adapted to mount to a surface of a display unit and a front surface opposite the mounting surface, the front surface including first and second opposing guide rails that project upwardly from a bottom of the front surface;

a first power rail and a second power rail disposed adjacent the bottom of the front surface, between first and second guide rails, each of the first and second power rails being constructed from a magnetic stainless steel base including a black oxide coating having a thickness of 0.1 microns to 3.0 microns; and a frame indexing element associated with the front surface of the elongated frame body;

a power supply electrically coupled to the low voltage power frame and set at 4 to 48 volts;

a lighting array comprising a board and a plurality of light emitting diodes spaced along the board, the board having an attachment element adapted for securement to the display unit;

a puck comprising:

a puck body constructed from a molded polymeric material, the puck body including a longitudinal axis, a front side, a rear side, a first lateral side, a second lateral side opposite the first lateral side, and an underside, the puck body being separate and distal from the lighting array;

a power feed including first and second electrical connectors mounted to the body;

a first puck electrical plate including a first plate upper portion and a first plate lower plate portion, the first upper plate portion embedded and encapsulated within the molded polymeric material of the puck body so that the first plate upper portion is concealed, the first plate lower portion extending out from the underside of the puck body, the first puck electrical plate electrically coupled to the first electrical connector of the power feed, a second puck electrical plate distal from the first puck electrical plate and including a second plate upper portion and a second plate lower portion, the second plate upper portion embedded and encapsulated within the molded polymeric material of the puck body so that the second plate upper portion is concealed, the second plate lower portion extending out from the underside of the puck body, the second puck electrical plate electrically coupled to the second electrical connector of the power feed, at least one magnetic element embedded and encapsulated in within the molded polymeric material of the puck body, the magnetic element magnetizing at least one of the first puck electrical plate and the second puck electrical plate so that at least one of the first puck electrical plate attracts to the first power rail and the second puck electrical plate attracts to the second power rail, thereby physically joining the puck with the low voltage frame substantially only via a magnetic force;

a puck indexing element associated with the underside of the puck and adapted to register with the frame indexing element so as to ensure the first puck electrical connector plate engages the first power rail and the second puck electrical connector plate engages the second power rail; and a flexible electrical coupler electrically coupled to the power feed of the puck and the lighting array so that power can be conveyed from the puck to the light emitting diodes to illuminate the light emitting diodes when the puck is joined with the low voltage frame via the magnetic force.

19. The lighting system of claim 18, wherein the puck indexing element is an elongated slot defined by the underside of the puck body, wherein the elongated slot extends from the front side to the back side, wherein the elongated slot is offset from the longitudinal axis of the puck body a preselected distance, whereby the offset of the slot ensures that the first electrical connector plate aligns with the first power rail, but not the second power rail of the low voltage power frame.

20. The lighting system of claim 19 wherein the frame indexing element is an elongated raised ridge configured to selectively interfit within the elongated slot of the puck when the first electrical connector plate is aligned with the first power rail.

* * * * *